US008403518B2

(12) United States Patent
Sohn

(10) Patent No.: US 8,403,518 B2
(45) Date of Patent: Mar. 26, 2013

(54) LIGHTING APPARATUS

(76) Inventor: Dae Up Sohn, Seoul (KR)

( * ) Notice: Subject to any disclaimer, the term of this patent is extended or adjusted under 35 U.S.C. 154(b) by 432 days.

(21) Appl. No.: 12/524,751

(22) PCT Filed: Feb. 1, 2008

(86) PCT No.: PCT/KR2008/000622

§ 371 (c)(1),
(2), (4) Date: Feb. 3, 2010

(87) PCT Pub. No.: WO2008/094013

PCT Pub. Date: Aug. 7, 2008

(65) Prior Publication Data

US 2010/0165609 A1 Jul. 1, 2010

(30) Foreign Application Priority Data

Feb. 1, 2007 (KR) ..... 10-2007-0010451

(51) Int. Cl.
*F21L 13/00* (2006.01)

(52) U.S. Cl. ..... 362/183; 362/157; 362/231; 362/192; 362/166

(58) Field of Classification Search ..... 362/157, 362/166, 167, 174, 192, 193, 231, 183, 293
See application file for complete search history.

(56) References Cited

U.S. PATENT DOCUMENTS

| | | | | |
|---|---|---|---|---|
| 2,086,218 | A * | 7/1937 | Eckold | 29/509 |
| 5,490,050 | A * | 2/1996 | Clark et al. | 362/263 |
| 6,979,098 | B2 * | 12/2005 | Petzl et al. | 362/177 |
| 7,077,540 | B2 * | 7/2006 | Yen | 362/183 |
| 7,222,984 | B2 * | 5/2007 | Lee | 362/192 |
| 7,745,957 | B2 * | 6/2010 | Bayat et al. | 307/115 |
| 2007/0091593 | A1 * | 4/2007 | Krieger et al. | 362/157 |
| 2007/0159815 | A1 * | 7/2007 | Bayat et al. | 362/157 |

* cited by examiner

*Primary Examiner* — Anabel Ton
(74) *Attorney, Agent, or Firm* — Novick, Kim & Lee, PLLC; Jae Youn Kim

(57) ABSTRACT

Disclosed herein is a portable lighting apparatus. The portable lighting apparatus includes a main body, one or more color filters, and an input jack and an output jack. The main body includes a light source. The color filters are provided so as to be moved to the light emission region of the light source. The input and output jacks are connected to a charging unit, which is provided in the main body.

15 Claims, 5 Drawing Sheets

LIGHTING APPARATUS

TECHNICAL FIELD

The present invention relates to a portable lighting apparatus, such as a flashlight or a lantern, and, more particularly, to a portable lighting apparatus, which can change the color of radiated illumination light to various colors using color filters having various colors, and can also be more easily charged by an external power source.

BACKGROUND ART

Generally, the term 'lighting apparatus' refers to a light using electricity. Of such lighting apparatuses, a portable lighting apparatus, which can be conveniently carried by a user, is used as an emergency light in the home when a power failure occurs, or is used to ensure night vision during leisure activities such as fishing or mountain climbing. Furthermore, the portable lighting apparatus is supplied with power using dry cells, rechargeable batteries, or separate batteries.

Examples of the portable lighting apparatus include a searchlight, a pocket light, and a flashlight. An example of the searchlight includes a light the focus of which can be freely adjusted to shine a long distance, which is called 'focusing.' Furthermore, a waterproof portable light is used as a general home light, as a rescue light, or as an underwater light, which is used when disaster strikes at sea, or as a fish-luring light, which is easy to use. For a special purpose, there is a signal light for indicating danger using a flashing yellow or red light, and a three-color signal light for enabling the color of light to change into three colors.

In the above-described portable lighting apparatus, the battery thereof is discharged when the usage time has elapsed, and thus usage is inconvenient because the battery must be replaced with a new battery. Accordingly, with the recent trend, various products, that is, various types of portable lighting apparatuses, in which a self generation structure is provided, are being marketed.

Meanwhile, when a conventional portable lighting apparatus is used for a military purpose or to send a rescue signal, color filters having various colors are mounted in a portion that emits light radiated from a light source for use thereof. These color filters are separately carried, or are configured to be stored in a storing part, which is provided in one side portion of the portable lighting apparatus.

Accordingly, the conventional portable lighting apparatus is disadvantageous in that, in the case where color illumination is necessary, it cannot be easily used because there is the risk of loss of or damage to the color filters.

DISCLOSURE OF INVENTION

Technical Problem

Accordingly, the present invention has been made keeping in mind the above problems occurring in the prior art, and an object of the present invention is to provide a portable lighting apparatus, which enables color filters to be more easily used when needed without the risk of loss or damage to the color filters.

Furthermore, another object of the present invention is to provide a portable lighting apparatus, which facilitates the input of external power, so that it can be very easily charged by an external power source.

Technical Solution

In order to accomplish the above objects, the present invention provides a portable lighting apparatus, including: a main body comprising a light source; one or more color filters, provided so as to be moved to the light emission region of the light source; and an input jack and an output jack, connected to a charging unit, which is provided in the main body.

It is preferred that the color filters move along guide paths, which are formed in respective side portions of the main body, thus covering the light emission region of the light source.

It is preferred that the color filters are hinged to respective side portions of the main body so as to be rotated, thus covering the light emission region of the light source.

The main body may further include a self-generation unit for internally generating power, the self-generation unit being connected with the charging unit of the main body.

The characteristics and advantages of the present invention will become more apparent from the following detailed description in conjunction with the accompanying drawings. Prior to reading the detailed description of the present invention, it must be understood that the terms or words used in the specification and claims of the present invention should not necessarily be understood according to their general meanings or dictionary definitions, but should be understood to have meanings and to represent concepts conforming to the technical spirit of the present invention, on the basis of the principle by which inventors can define the concept of terms properly to explain their invention in the best way.

Advantageous Effects

The lighting apparatus of the present invention is configured such that the color filters are hinged to the main body so as to slide or rotate to thus cover the light emission region of the light source, which enables the color filters to be more easily used when needed, without the risk of loss of or damage to color filters.

Furthermore, in the present invention, the charging jack, which is connected to the generator of a self-generation unit, is provided on one side surface of the main body so as to be exposed to the outside, so that the present invention is advantageous in that the power charging of other portable electronic products, such as mobile phones, as well as the self-charging of the portable lighting apparatus can be facilitated.

DESCRIPTION OF REFERENCE NUMERALS OF PRINCIPAL ELEMENTS

Figure 1:
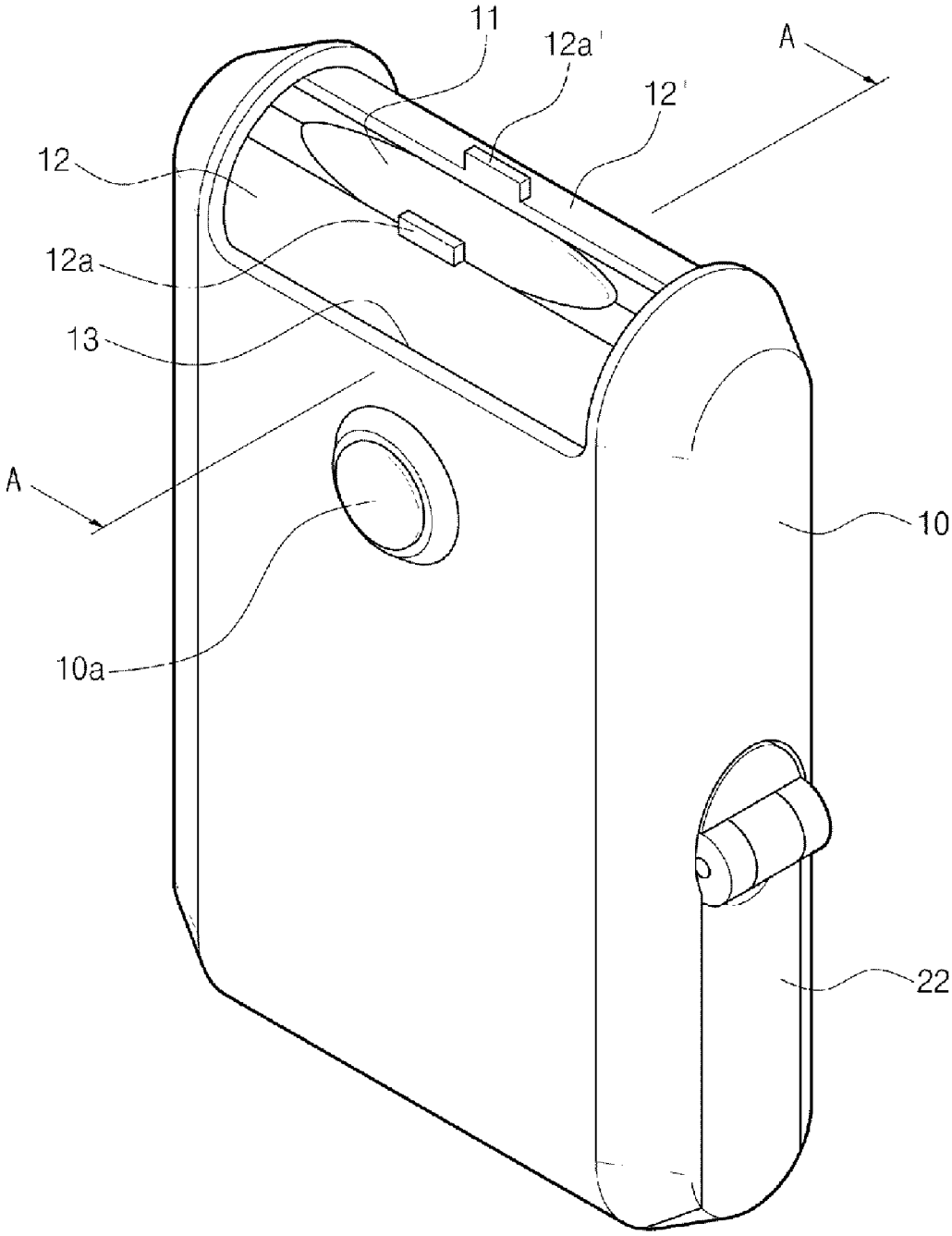
FIG. 1 is a perspective view showing a lighting apparatus according to a first embodiment of the present invention.

10: main body
11: light source
12: color filters
20,30: self-generation units

MODE FOR THE INVENTION

The above and other objects, features and advantages of the present invention will be more apparent from the following detailed description.

A lighting apparatus according to a preferred embodiment of the present invention is described in detail with reference to the accompanying drawings below.

First, it should be noted that the same reference numerals are used throughout the different drawings to designate the same or similar components. In the description of the present invention, descriptions of related well-known functions or constructions are omitted so as not to make the gist of the present invention unclear.

Figure 2:
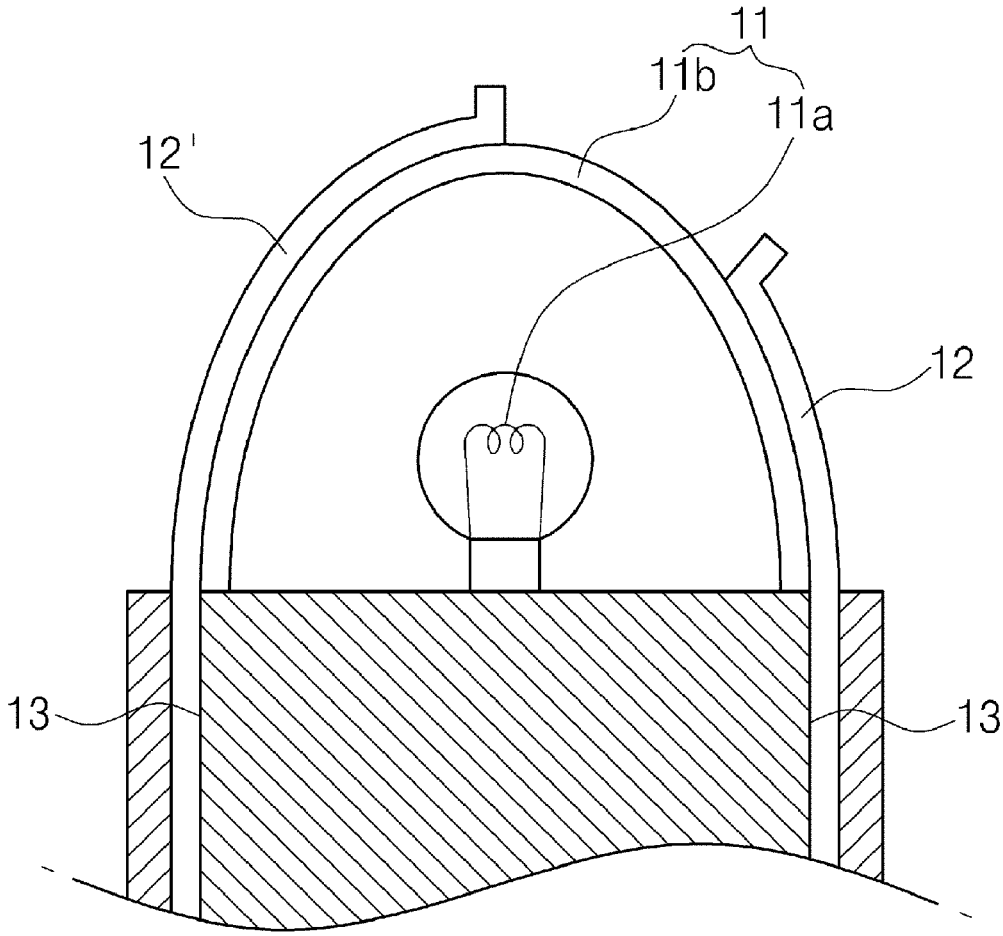
FIG. 2 is a sectional view taken along line A-A of FIG. 1.
Figure 3:
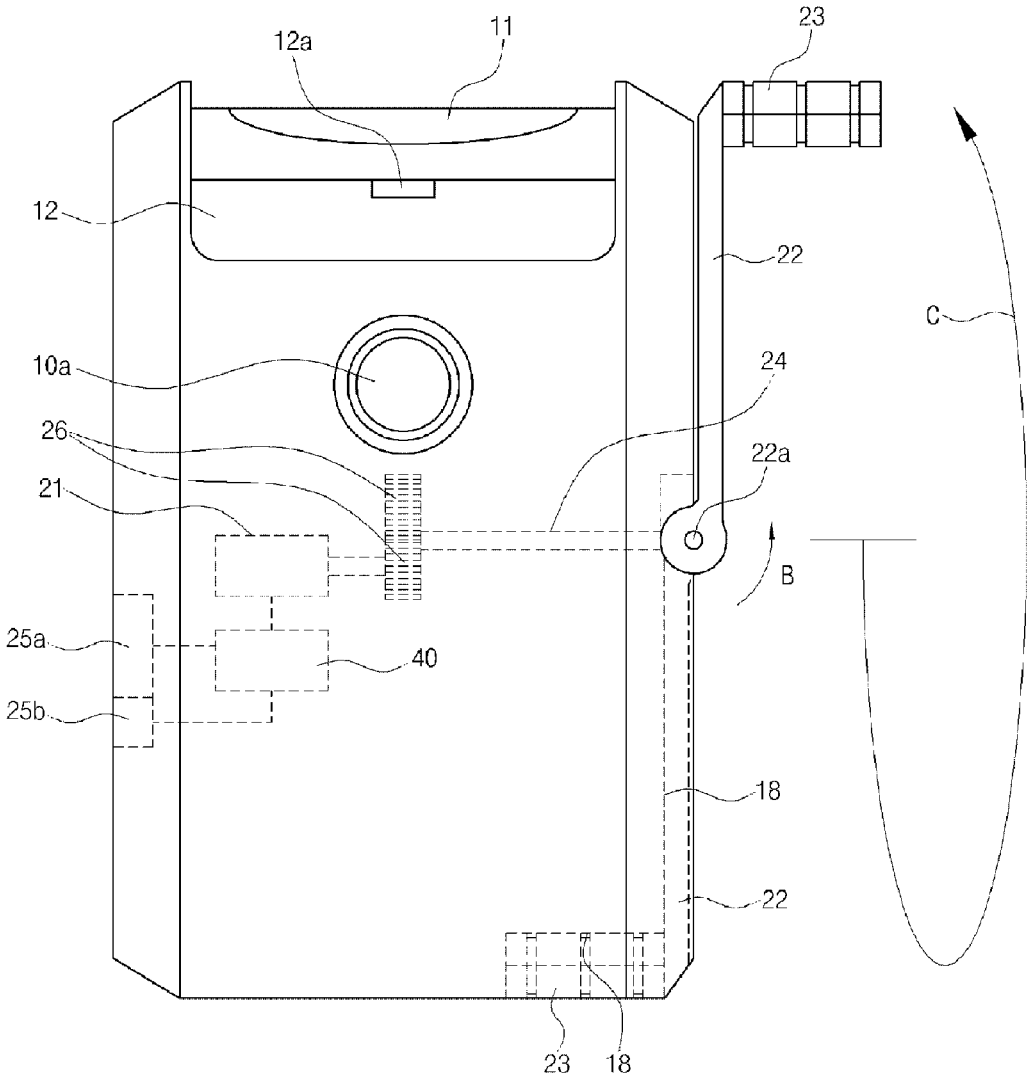
FIG. 3 is a front sectional view showing the lighting apparatus according to the first embodiment of the present invention.

FIGS. 1 to 3 show a portable lighting apparatus according to an embodiment of the present invention.

As shown in the drawings, the portable lighting apparatus of the present invention includes a main body 10, which includes a light source 11, at least one color filter 12, which is configured to cover the light emission region of the light source 11, and an input jack 25*a* and an output jack 25*b*, which are connected to a charging unit 40, which is provided in the main body 10.

The main body 10 includes the light source 11 in one end thereof. The light source 11 includes at least one light emitting element 11*a*, such as a Light Emitting Diode (LED) and a filament bulb. A light emission lens 11*b* is provided in front of the light emitting element 11*a*. The light emission lens 11*b* is made of transparent or semi-transparent material, and is disposed close to the light emission region of the light emitting elements 11*a*. Furthermore, the light emission lens 11*b* may be implemented using various types of lenses, such as convex lenses, having various types of curved surfaces, and lenses having structures formed of combinations of convex lenses and concave lenses. The above-described light emission lens 11*b* may emit the light radiated from the light emitting element 11*a* over a widened light emission range, or may condense and emit the light radiated from the light emitting element 11*a* within a narrow range.

Furthermore, an On/Off switch 10*a* for turning on and off the light source 11 is provided on one side surface of the main body 10.

The at least one color filter 12, as shown in FIGS. 1 and 2, may be slidably mounted to the main body 10 so as to cover the light emission region of the light source 11.

Color filters 12 and 12' may have various colors, such as red, blue and yellow, may have high light transmissivity, and may be made of flexible material having favorable heat- and light-resisting characteristics.

As shown in FIG. 2, the above-described color filters 12 and 12,' which are made of flexible material, may be slid along guide paths, which are formed in respective side portions of the main body 10. Holding parts 12*a* and 12*a*' enabling a user to easily hold the main body 10 may be provided in the outer end of the main body 10.

Meanwhile, as shown in FIG. 2, the color filters 12 and 12,' having different colors, are mounted on respective sides of the main body 10 and selectively cover the light emission region of the light source 11. Accordingly, the lighting apparatus of the present invention can radiate various kinds of color illumination light.

Furthermore, the color filters 12 and 12,' having different colors, may be configured to overlap each other and to slide.

Figure 4:
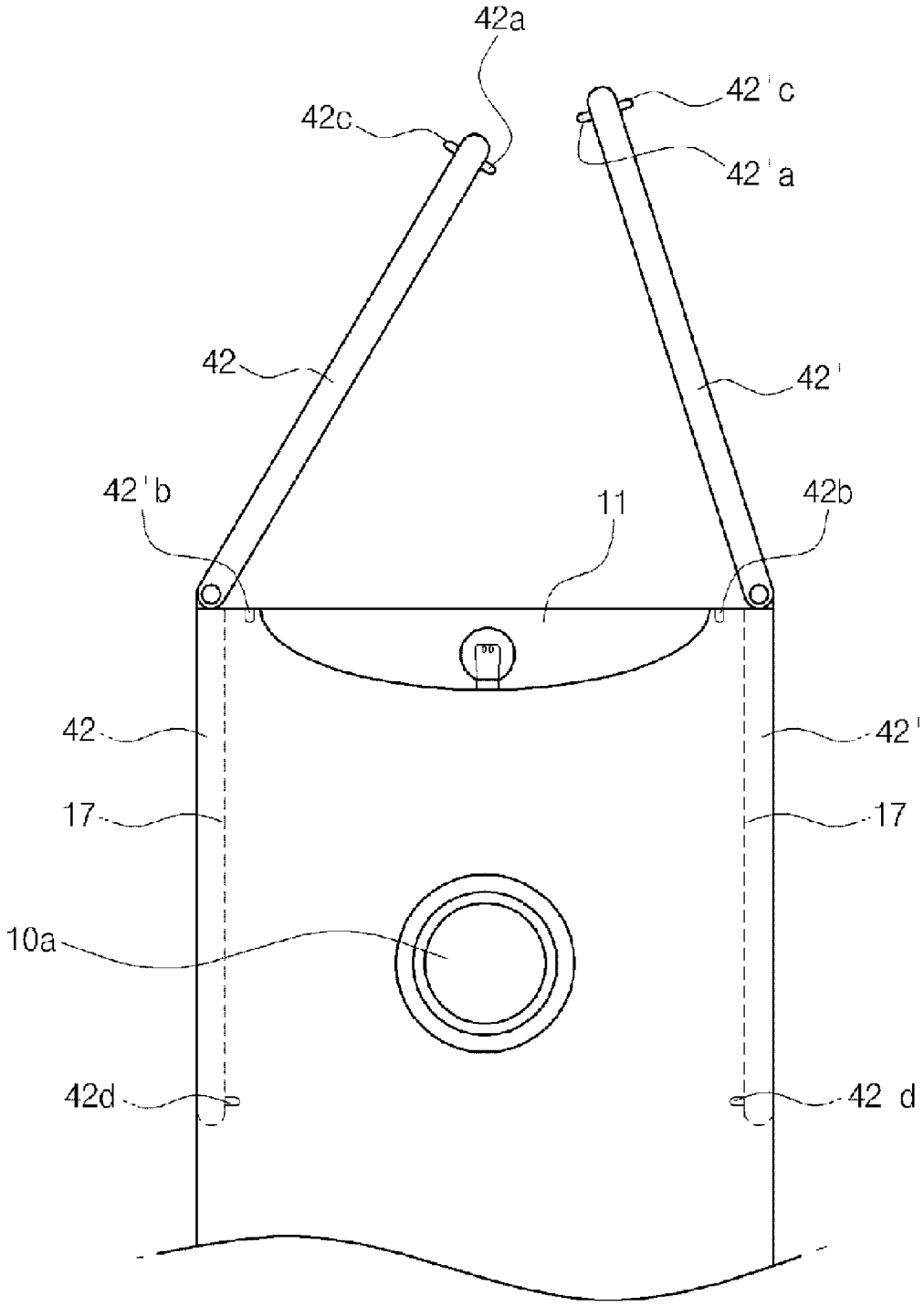
FIG. 4 is a front view showing a lighting apparatus according to a second embodiment of the present invention.

As shown in FIG. 4, color filters 42 and 42' according to another embodiment of the present invention may be configured such that first ends thereof are hinged to respective side portions of the main body 10 so as to rotate, and thus the light emission region of the light source 11 can be covered.

Furthermore, the main body 10 has mounting grooves 17 and 17,' which are formed in one side portion of the main body 10 or in respective side portions of the main body 10. The color filters 42 and 42,' which can be rotated toward the main body 10, are mounted in the respective mounting grooves 17 and 17.' Accordingly, the color filters 42 and 42' can be prevented from being exposed to the outside.

The color filters 42 and 42' have respective free ends. The free ends are provided with one or more engaging protrusions 42*a*, 42*c*, 42*a*' and 42*c*.' Engaging depressions 42*b*, 42*d*, 42*b*' and 42*d*' are formed in the main body 10 to correspond to the engaging protrusions 42*a*, 42*c*, 42*a*' and 42*c*.' Accordingly, when the color filters 42 and 42' are rotated toward the mounting grooves 17 and 17' or toward the light emission region of the light source 11, the engaging protrusions 42*a*, 42*c*, 42*a*' and 42*c*' are engaged with and locked to the engaging depressions 42*b*, 42*d*, 42*b*' and 42*d*,' thus the rotation of the color filters 42 and 42' can be restricted.

The charging unit 40, which is charged by an external or internal power source, is provided in the main body 10. The input jack 25*a*, which is connected to the cigarette lighter jack of a vehicle or other external power source for power charging, is provided in the charging unit 40. The above-described input jack 25*a* may be formed to have various structures, such as a Universal Serial Bus (USB) port structure, a peripheral Component Interconnect (PCI) port structure, and a cigarette lighter jack structure. Accordingly, the present invention is advantageous in that it can receive power from various external power devices via the input jack 25*a*, and can be charged by the received power.

Furthermore, the output jack 25*b* may be connected to the charging unit 40. This output jack 25*b* may be formed to have various structures, such as a USB port structure and a PCI port structure. Accordingly, the present invention is advantageous in that it can greatly increase the convenience of use thereof, because mobile phones or portable audio and/or video devices can be easily charged via the output jack 25*b*.

That is, the present invention is advantageous in that it can achieve convenient power charging by causing the charging unit 40 to receive external power via the input jack 25*a*, and in that it can charge an external electronic product by outputting the charged power of the charging unit 40 to the external electronic product via the output jack 25*b*.

Furthermore, the lighting apparatus of the present invention may further include a self-generation unit 20 or 30, which can charge the charging unit 40 by internally generating power.

An example of the above-described self-generation unit 20 is illustrated in FIG. 3. This self-generation unit 20 includes a generator 21, which is provided in the main body 10. The charging unit 40 is connected to the generator 21.

Furthermore, gear trains 26 are connected to the generator 21. A rotary shaft 24 is connected to the gear trains 26. A rotary lever 22 is coupled to the rotary shaft 24 so as to be rotated using a hinge 22*a*. A handle 23 is provided in the free end of the rotary shaft 24.

Furthermore, a mounting groove 18 for holding the rotary lever 22 and the handle 23 is formed in one side portion of the main body 10. Accordingly, when the rotary lever 22 is rotates around the hinge 22*a* toward the main body 10, the rotary lever 22 and the handle 23 according to the present invention may be mounted in the one side portion of the main body 10 so as to be hidden.

In the above-described construction of the self-generation unit 20, when the rotary lever 22 is rotated in the direction of the arrow B and is thereafter rotated in the direction of the arrow C or in the direction opposite that of the arrow C while the handle 23 is gripped, the rotary shaft 24 is rotated, and thus rotational force is transmitted to the generator 21 via the gear trains 26. Accordingly, the generator 21 generates a predetermined amount of electrical energy and transmits the generated electrical energy to the charging unit 40, thus performing charging.

Figure 5:
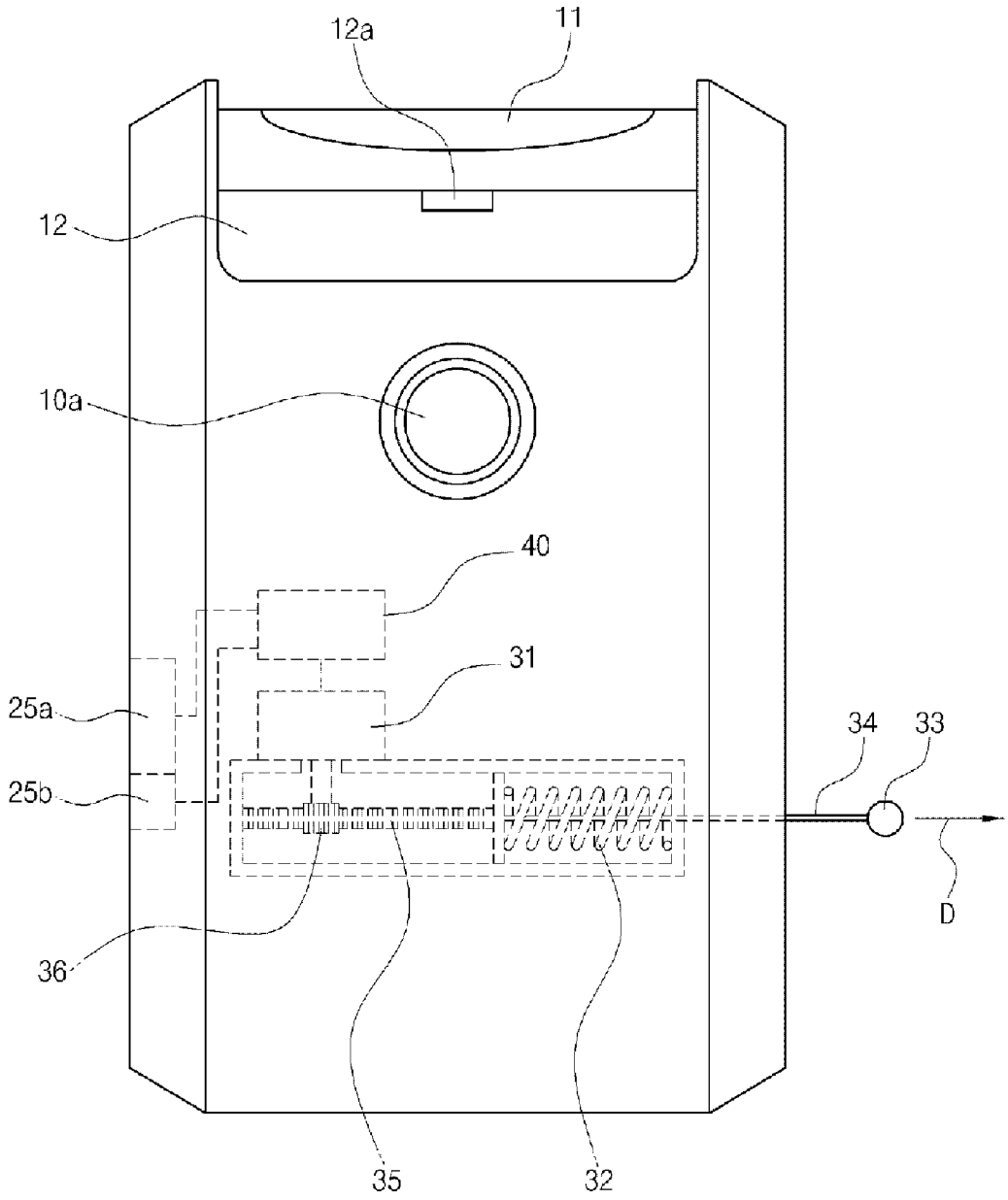
FIG. 5 is a front sectional view showing the lighting apparatus according to the second embodiment of the present invention.

Meanwhile, an example of the self-generation unit 30 is illustrated in FIG. 5. This self-generation unit 30 may have a structure in which the generator 31, to which the charging unit 40 is connected, is provided in the main body 10, a pinion 36 is connected to the generator 31 via a shaft, a rack 35 is engaged with the pinion 36, a drive string 34 is connected to the rack 35, the rack 35 is restored by an elastic member 32, such as a spring, and a handle 33 is provided at the end of the drive string 34.

In the above-described construction of the self-generation units 30, when the handle 33 is pulled out in the direction of the arrow D and is then released as shown in FIG. 5, the rack 35 reciprocates linearly by the elastic member 32, and thus the pinion 36 rotates bi-directionally while. Accordingly, the rotational force caused by the pinion 36 is transmitted to the generator 31, and thus the generator 31 generates electrical energy and transmits the generated electrical energy to the charging unit 40, thus achieving charging.

The self-generation units 20 and 30 of the present invention, described above, are not limited to the structures illustrated in FIGS. 3 and 5, and may be implemented to have various structures.

The present invention is not defined by the above-described embodiments and the accompanying drawings, and it will be apparent to those skilled in the art that various modifications and variations are possible within the range that does not depart from the technical spirit of the present invention. Accordingly, it should be understood that the modifications or variations described above are included in the accompanying claims.

The invention claimed is:

1. A portable lighting apparatus, comprising: a main body comprising a light source;

a filter moving means which is formed in respective side portions of the main body and includes a guide path or a rotatable hinge;

a plurality of color filters which are coupled to the filter moving means and are movable independently of each other to a light emission region of the light source; and an input jack and an output jack, connected to a charging unit, which is provided in the main body.

2. The portable lighting apparatus according to claim 1, wherein the color filters move along the filter moving means, thus covering the light emission region of the light source.

3. The portable lighting apparatus according to claim 1, wherein the main body further comprises a self-generation unit for internally generating power, the self-generation unit being connected with the charging unit of the main body.

4. A portable lighting apparatus, comprising:

a main body comprising a light source;

one or more color filters slidably coupled to the main body so as to be moveable to and from a light emission region of the light source; and an input jack and an output jack, connected to a charging unit, which is provided in the main body, wherein when the one or more color filters are moved to the light emission region, light from the light source passes through the one or more color filters.

5. The portable lighting apparatus according to claim 4, wherein the one or more color filters comprises a plurality of color filters.

6. The portable lighting apparatus according to claim 5, wherein each of the plurality of color filters are independently movable respect to one another to and from the light emission region of the light source.

7. The portable lighting apparatus according to claim 4, wherein the main body further comprises a self-generation unit for internally generating power, the self-generation unit being connected with the charging unit of the main body.

8. The portable light apparatus according to claim 4 wherein the one or more color filters are slidably coupled to the main body via a guide path.

9. A portable lighting apparatus, comprising:

a main body comprising a light source;

one or more color filters rotatably coupled to the main body so as to be moveable to and from a light emission region of the light source; and an input jack and an output jack, connected to a charging unit, which is provided in the main body, wherein when the one or more color filters are moved to the light emission region, light from the light source passes through the one or more color filters.

10. The portable lighting apparatus according to claim 9, wherein the one or more color filters are rotatable coupled to the main body via a hinge.

11. The portable lighting apparatus according to claim 9, wherein the one or more color filters comprises a plurality of color filters.

12. The portable lighting apparatus according to claim 11, wherein each of the plurality of color filters are independently movable respect to one another to and from the light emission region of the light source.

13. The portable lighting apparatus according to claim 9, wherein the main body further comprises a self-generation unit for internally generating power, the self-generation unit being connected with the charging unit of the main body.

14. The portable lighting apparatus according to claim 9 further comprising mounting grooves formed in respective side portions of the main body.

15. The portable lighting apparatus according to claim 9, wherein the one or more color filters comprise engaging protrusions, wherein the main body further comprises engaging depressions, and wherein the engaging protrusions of the one or more color filters engage and lock into the engaging depressions in the main body when the one or more color filters are moved to the light emission region or from the light emission region.

* * * * *